United States Patent [19]

Fujimura et al.

[11] Patent Number: 4,485,141

[45] Date of Patent: Nov. 27, 1984

[54] POLYOLEFIN FOAMED FIBERS AND PROCESS PRODUCING THE SAME

[75] Inventors: Isao Fujimura, Moriyamashi; Sadaaki Nakajima; Morio Abe, both of Shigaken; Masahiko Taniguchi, Moriyamashi, all of Japan

[73] Assignee: Chisso Corporation, Osaka, Japan

[21] Appl. No.: 582,639

[22] Filed: Feb. 22, 1984

[51] Int. Cl.[3] ..... D04H 1/58

[52] U.S. Cl. ..... 428/288; 264/45.9; 428/314.2; 428/362; 428/373; 428/374; 428/398; 428/400; 428/401

[58] Field of Search ..... 428/362, 398, 401, 288, 428/314.2, 373, 374, 400; 264/45.9

[56] References Cited

U.S. PATENT DOCUMENTS

| | | | |
|---|---|---|---|
| 3,760,046 | 9/1973 | Schwartz et al. | 264/147 |
| 3,785,919 | 1/1974 | Hickman | 428/400 |
| 4,265,972 | 5/1981 | Rudner | 428/401 |

FOREIGN PATENT DOCUMENTS 0047795 9/1980 European Pat. Off. .

*Primary Examiner*—James J. Bell

*Attorney, Agent, or Firm*—Fred Philpitt

[57] ABSTRACT

Polyolefin foamed fibers consisting of composite fibers having a good spinnability, a small fineness and a non-waxy feeling, and a process for producing the same are provided, which foamed fibers having a structure wherein only a composite component (B) dominantly forming the fiber surface of composite fibers along the direction of the fiber axis thereof is substantially foamed and a part of the resulting foamed cells are burst open on the fiber surface, and which process comprises adding a foaming agent only to the above component (B) and combining two composite components so that the composite ratio thereof is 30/70 or higher and the theoretical average thickness of the component (B) in the cross-section of the unstretched fibers is 2 to 15 microns.

6 Claims, 1 Drawing Figure

POLYOLEFIN FOAMED FIBERS AND PROCESS PRODUCING THE SAME

BACKGROUND OF THE INVENTION

1. Field of the Invention

This invention relates to polyolefin foamed fibers and a process for producing the same. More particularly it relates to polyolefin composite fibers of side-by-side type or sheath-and-core type wherein foamed cells are contained only in one of the components of the fibers and a part of the cells burst open on the fiber surface, and a process for producing the same.

2. Description of the Prior Art

Polyolefin fibers such as fibers of polypropylene, polyethylene or the like have an advantage of small density and great strength, but on the other hand, they have a drawback of giving a feeling called generally as a "numeri" feeling in Japanese (or a slimy feeling) or a waxy feeling. Particularly in the case of fibers of small fineness, a problem that this slimy feeling is promoted has been raised. In order to overcome this drawback, the so-called irregular shape fibers taking various forms of fiber cross-section other than circular form have been proposed, but any satisfactory products have never been obtained.

The present inventors have made strenuous efforts for developing polyolefin fibers having a small fineness without any slimy feeling, and as a result have found that when fibers are foamed and a part of the resulting foamed cells is caused to burst open on the fiber surface, it is possible to obtain polyolefin fibers having a suprior feeling.

SUMMARY OF THE INVENTION

The present invention resides in as a first aspect, polyolefin foamed fibers consisting of composite fibers having a single fiber fineness of 0.5 to 30 deniers and a fiber strength of 1.5 to 5.0 g/d, characterized in a structure wherein only a composite component dominantly forming the fiber surface of composite fibers along the direction of surface of composite fibers along the direction of the fiber axis thereof is substantially foamed and a part of the resulting foamed cells are burst open on the fiber surface; and as a second aspect, in producing composit fibers having a single fiber fineness of 0.5 to 30 deniers by stretching unstretched fibers having a single fiber fineness of 1.5 to 130 deniers to 2 to 8 times the original length thereof, a process for producing polyolefin foamed fibers which comprises adding a foaming agent substantially only to a composite component dominantly forming the fiber surface of composite fibers along the fiber axis thereof (which component will hereinafter be abbreviated to B component), without adding any foaming agent to another composite component (which will hereinafter be abbreviated to A component), and combining the composite components so that the composite proportion thereof, i.e. (A component)/(B component), is 30/70 or higher, and the theoretical average thickness of the B component in the cross-section of the unstretched fibers is in the range of 2 to 15 microns.

DETAILED DESCRIPTION OF THE INVENTION

Figure 1:
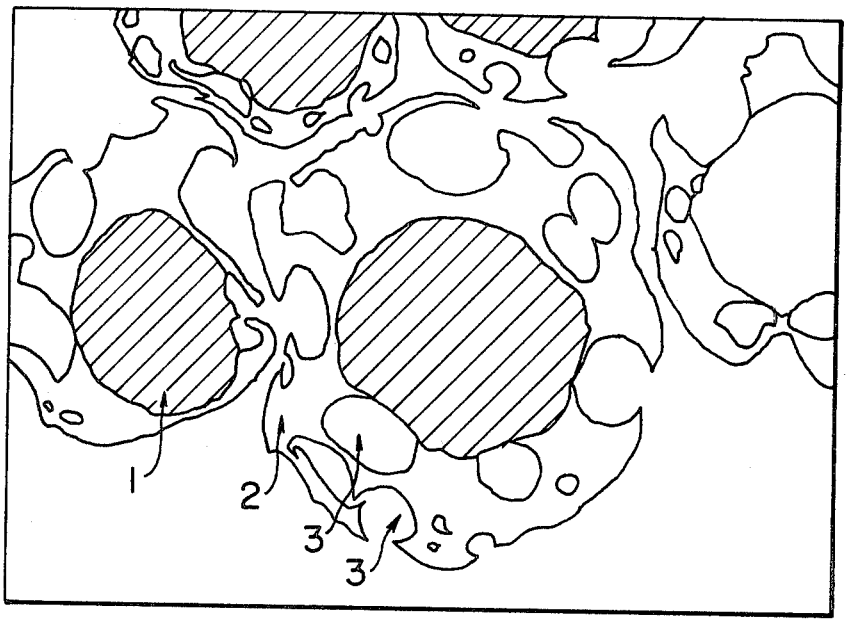
FIG. 1 shows a schematic view of the cross-section of foamed fibers obtained in Example 1 wherein numerals 1, 2, and 3 represents a core component, a sheath component and foams, respectively.

Production of foamed fibers according to melt-spinning process has so far been known as disclosed in Japanese patent publications No. Sho 43-4536/1968, No. Sho 45-36339/1970, No. Sho 55-40682/1980, etc., but any of these Publications is directed to rigid fibers having a single fiber fineness in the vicinity of 500 deniers, the so-called monofilament, and aims at more reducing fiber specific gravity, imparting brilliance to fibers and toughness of fibers. The size of the foamed cells in melt-extruded unstretched fibers is generally in the range of about 5 to 15 microns, and in the case of thick foamed fibers as described above, the size of foamed cells is far smaller than the fiber diameter (several hundreds to several thousands microns); hence it is relatively easy to subject such fibers to melt-spinning.

Whereas, in the case of fibers having a small fineness of 30 deniers or less, aimed in the present invention, the fineness of unstretched fibers is at most only 130 deniers or less, and the fiber diameter corresponding thereto is about 130 microns; hence even if such fibers should have been attempted to obtain in the form of foamed fibers; this has been very difficult, since the size of the foamed cells relative to the fiber diameter is excessive; the continuity of fiber-forming polymers extruded from spinning nozzles is hindered by foamed cells; and stringiness becomes inferior. In particular, in the case as in the present invention where as many foamed cells as possible are burst open on the fiber surface to form cracks on the surface whereby the resulting fibers have an improved feeling, a high foaming ratio (ratio of gas phase/solid phase) is required and hence spinning becomes still more difficult.

In the present invention, by foaming only a composite component dominantly forming the fiber surface of composite fibers along the fiber axis thereof, without foaming another composite component, the above spinning difficulty can be overcome, and the stringiness, stretchability and strength of fibers as a whole thereof are held due to the holding effectiveness of the other composite component which substantially does not foam at the time of composite spinning. As a similar invention to the present one, Japanese Patent Publication No. Sho 43-547/1968 discloses a process for producing composite fibers wherein only the outer layer thereof is foamed, but the resulting fibers have a fineness as large as 800 to 900 deniers and polyolefins cannot be used in the outer layer; thus, foamed fibers having a small fineness, aimed in the present invention, have never been known.

Polyolefins used for foamed fibers of the present invention have no particular limitation. For example, any of homopolymers of ethylene, propylene, 4-methylpentene-1, etc., copolymers composed mainly thereof or mixtures of these polymers may be used. It is also possible to admix additives conventionally used for polyolefins such as stabilizer, pigment, antistatic agent, etc. to the polymers.

For the foamed fibers of the present invention, any of foaming agents conventionally used for expansion molding of polyolefins may be used. Examples of the agents are azodicarbonamide, barium azodicarboxylate, N,N'-dinitrosopentamethylenetetramine, p-toluenesulfonyl semicarbazide, trihydrazinotriazine, etc. The amount of these foaming agents added are generally in the range of 0.1 to 2.0% by weight, preferably 0.2 to 1.0% by weight, based on the foamed component (B), although the amount is adequately adjusted depending on the fineness of the aimed fibers, the thickness of the foamed component (B), etc.

The foamed fibers of the present invention can be produced using so far known composite-spinning dice of sheath-and-core type or side-by-side type, and as the components to be made composite, it is possible to choice optional combinations of various kinds of the above polyolefins (including the same kind), but in order that the effectiveness of feeling improvement brought about by the foamed layer is exhibited, it is most preferred that the composite fibers be those of sheath-and-core type wherein the sheath component is foamed, and in the case of composite fibers of side-by-side type, those of eccentric side-by-side type are preferred wherein a component dominantly forming the fiber surface along the direction of the fiber axis is foamed.

In order that a part (as many as possible) of the foamed cells generated in the foamed component (B) of the above composite fibers are burst open on the fiber surface, the theoretical average thickness of the foamed component (B) in the cross-section of melt-extrudded unstretched fibers is required to be in the range of 2 to 15 microns. Namely, the size of foamed cells generated in the unstretched fibers is in the range of about 5 to 15 microns in terms of diameter under conventional spinning conditions. If the theoretical average thickness of the foamed component (B) exceeds the diameter of the foamed cells, the proportion of foamed cells which burst open on the fiber surface is reduced, and the effectiveness of feeling improvement becomes inferior in the same amount of foaming agent added, while if the addition amount is increased, spinnability becomes inferior. To the contrary, if the thickness of the foamed component (B) is less than 2 microns, the size of foamed cells is excessive relative to the thickness and it is impossible to form acute-like projections and depressions on the fiber surface. The theoretical average thickness of the foamed component (B) referred to herein means the average thickness of the sheath component of unstretched fibers as calculated from the composite ratio of composite fibers of sheath-and-core type, imazining that no foaming agent is added. In the case of composite fibers of side-by-side type, the above thickness is calculated by calculating the composite ratio of the composite fibers of side-by-side type from that of sheath-and-core type, followed by correcting the resulting value with the percentage occupation of the foamed component (B) on the fiber surface.

In the foamed fibers of the present invention, it is necessary for retaining the stringiness, stretchability and strength of fibers that in the case of composite fibers of sheath-and-core type, the core component is substantially not foamed, while in the case of composite fibers of side-by-side type, a component having a lower percentage occupation on the fiber surface is substantially not foamed. Further it is also necessary that the composite ratio of such a non-foamed component (A) to the above foamed component (B) be 30/70 or more.

The spinning conditions for obtaining the foamed fibers of the present invention should be adequately established depending on the kinds of polyolefins and foaming agents used, but general spinning conditions for polyolefin composite fibers may be applied nearly as they are. For example, spinning is carried out by melt-extruding polyolefins at a spinning temperature of 180° to 350° C. and at a spinning rate of 200 to 4,000 m/min., cooling by air just below a spinning die and taking up in a draft ratio of 100 to 3,000 to obtain foamed unstretched fibers having 1.5 to 130 deniers, which are then stretched to 2 to 8 times the original length to obtain foamed stretched fibers having a single fiber fineness of 0.5 to 30 deniers. Along with this stretching, a large number of fine grooves are formed on the fiber surface along the direction of the fiber axis, and at the same time the fibers have a distorted shape whereby their feeling is much improved and a fiber strength endurable to the secondary processing is imparted.

As described above in detail, the present invention has made it possible to produce polyolefin foamed fibers having a small fineness and also provides polyolefin fibers having a small fineness without any slimy feeling. The foamed fibers of the present invention have fine and random grooves on the fiber surface unlike a relatively large and regular shape of projections and depressions as seen in conventional, so-called fibers of irregular cross-section; hence the foamed fibers are more deficient in slimy feeling than the above fibers of irregular cross-section and also have a wool-like feeling. Further since the foamed fibers contain foamed cells inside the fibers, they also exhibit an effectiveness of reducing the fiber density.

The foamed fibers of the present invention are usable in the fiber shape of crimped yarns or non-crimped yarns, short fibers or long fibers, for various application fields such as woven fabrics, knit fabrics, non-woven fabrics, paper-making, etc.

For example, the foamed fibers may be used as short fibers for dry non-woven fabrics. In this case, those having a crimp number of 5 to 15 crimps/inch and a fiber length of 30 to 180 mm are preferable. Further, the foamed fibers may be used as chopped strands for paper-making. In this case, those which are non-crimped and have a fiber length of 1 to 20 mm are preferable. Furthermore the foamed fibers may be non-crimped or crimped multifilaments.

The present invention will be concretely described by way of Examples.

EXAMPLES 1 AND 2 AND COMPARATIVE EXAMPLES 1-3

Spinning was carried out under the following conditions:

- Die used: a sheath-and-core type composite spinning die having a hole diameter of 1.0 mm and 240 holes,
- Polymers used for sheath component and core component: both, a polypropylene having a melt flow rate (according to JIS K6758) of 21.3, the composite ratio thereof being indicated in Table listed later,
- Foaming agent used: azodicarbonamide (decomposition temperature, 190°-210° C.), its amount used being indicated in Table listed later,
- Total amount extruded: 200 g/min.,
- Melt-extrusion temperature: 260° C.,
- Cooling air between 5 cm and 80 cm below the surface of spinning die: 23° C.×0.3 m/sec., and Take-up rate: 714 m/min.

In Examples 1 and 2, foamed unstretched fibers having a superior spinnability and a single fiber fineness of 10.5 deniers were obtained, but in any of Comparative examples 1-3, spinnability was much inferior to make it impossible to gather foamed unstretched fibers.

The above foamed unstretched fibers obtained in Examples 1 and 2 were stretched at a stretch ratio of 4.1 or 3.7 times, respectively and subjected to a mechanical crimp (14 crimps/inch), followed by cutting the fibers to a fiber length of 51 mm to obtain foamed short fibers having a single fiber fineness of 3.0 or 3.3 deniers, respectively. These foamed short fibers were passed through a carding machine for opening to obtain webs. The feeling of these webs was evaluated in contrast to that of a web of non-foamed short fibers having 3.0 deniers, and as a result the fibers had an entirely non-slimy, soft and clean feeling.

EXAMPLE 3

Example 1 was repeated except that a low pressure process polyethylene having a melt index (according to JIS K6760) of 23.0 was used as a sheath component and a polypropylene having a melt flow rate (according to JIS K6758) of 6.8 was used as a core component to obtain short fibers wherein the sheath component alone was foamed, which fibers were then passed through a carding machine to obtain a web, which also exhibited a superior feeling as in the case of Example 1.

EXAMPLE 4

Spinning was carried out under the following conditions:

- Die used: a side-by-side type composite spinning die having a hole diameter of 1.0 mm and 240 holes,
- Composite component A: a polypropylene having a melt flow rate of 6.8,
- Composite component B: a polypropylene having a melt flow rate of 21.3 and containing 0.4% of azodicarbonamide as a foaming agent,
- Composite ratio: 50/50,
- Total amount extruded: 200 g/min.,
- Melt-spinning temperature: 280° C.,
- Cooling air between 5 cm and 80 cm below the surface of spinning die: 23° C.×0.3 m/sec., and
- Take-up speed: 714 m/min.

to obtain foamed unstretched fibers having a single fiber fineness of 10.5 deniers.

The cross-section of the above unstretched fibers was observed with an optical microscope and it was found that B component (a component on the foamed side) took such an arrangement that it surrounded A component (a component on the non-foamed side) and occupied 78% of the peripheral length of the fiber cross-section. The unstretched fibers were stretched in a stretch ratio of 3.8 times and subjected to a mechanical crimp (12.8 crimps/inch), followed by cutting the fibers to a fiber length of 51 mm to obtain fomaed short fibers having a single fiber fineness of 3.3 deniers.

A web consisting of the foamed short fibers had all the same feeling as in Example 1.

EXAMPLES 5-7 AND COMPARATIVE EXAMPLES 4-6

Spinning was carried out under the following conditions:

- Die used: a sheath-and-core type composite spinning die having a hole diameter of 1.5 mm and 60 holes,
- Sheath component and core component: both, a polypropylene having a melt flow rate of 6.8,
- Composite ratio: indicated in Table listed later,
- Foaming agent: p-toluenesulfonyl semicarbazide, its amount added being indicated in Table listed later,
- Melt-spinning temperature: 260° C.,
- Cooling air between 5 cm and 80 cm below the surface of spinning die: 23° C.×0.3 m/sec., and
- Take-up rate: 500 m/min.

In any case of Examples 5-7, spinnability was good and in the case of Comparative example 5, spinnability was also tolerably good; thus in any of these cases, it was possible to obtain foamed unstretched fibers having a single fiber fineness of 60 deniers. Whereas in both the cases of Comparative examples 4 and 6, spinnability was inferior to make it impossible to gather unstretched fibers.

The above foamed unstretched fibers were stretched in stretch ratios indicated in Table listed later and crimped so as to give 14 crimps/inch, followed by cutting the fibers to a fiber length of 64 mm and then passing through a carding machine for opening to obtain webs, which were then subjected to feeling evaluation. Webs obtained in Examples 5 and 6 exhibited a non-slimy good feeling. Whereas a web obtained in Comparative example 5 had a small amount of a foaming agent relative to the thickness of the sheath part in the foam fibers; hence the amount of foamed cells burst open on the fiber surface was so small that a slimy feeling remained in the web.

TABLE

| | Spinning conditions | | | | | |
|---|---|---|---|---|---|---|
| | | | | | Amount of foaming agent added | |
| | Composite type | A component*1 | B component*1 | Composite ratio (A/B) | A component (%) | B component (%) |
| Example 1 | Sheath and core | PP 21.3 | PP 21.3 | 50/50 | 0 | 0.4 |
| Example 2 | Sheath and core | PP 21.3 | PP 21.3 | 35/65 | 0 | 0.4 |
| Compar. ex. 1 | Sheath and core | PP 21.3 | PP 21.3 | 20/80 | 0 | 0.4 |
| Compar. ex. 2 | Sheath and core | PP 21.3 | PP 21.3 | 50/50 | 0.4 | 0.4 |
| Compar. ex. 3 | Sheath and core | PP 21.3 | PP 21.3 | 50/50 | 0.2 | 0.2 |
| Example 3 | Sheath and core | PP 6.8 | PE 23 | 50/50 | 0 | 0.4 |
| Example 4 | Side by side | PP 6.8 | PP 21.3 | 50/50 | 0 | 0.4 |

TABLE-continued

| | | | | | | |
|---|---|---|---|---|---|---|
| Example 5 | Sheath and core | PP 6.8 | PP 6.8 | 50/50 | 0 | 0.8 |
| Example 6 | Sheath and core | PP 6.8 | PP 6.8 | 70/30 | 0 | 0.8 |
| Example 7 | Sheath and core | PP 6.8 | PP 6.8 | 85/15 | 0 | 0.8 |
| Compar. ex. 4 | Sheath and core | PP 6.8 | PP 6.8 | 25/75 | 0 | 0.8 |
| Compar. ex. 5 | Sheath and core | PP 6.8 | PP 6.8 | 35/65 | 0 | 0.8 |
| Compar. ex. 6 | Sheath and core | PP 6.8 | PP 6.8 | 35/65 | 0 | 1.2 |

| | Unstretched fiber | | | Stretched fiber | | | |
|---|---|---|---|---|---|---|---|
| | Fineness (d) | Theoretical thickness of B component (μ) | Spinnability | Stretch ratio | Fineness (d) | Feeling | Strength (g/d) |
| Example 1 | 10.5 | 6.0 | good | 4.1 | 3.0 | good | 3.2 |
| Example 2 | 10.5 | 7.5 | good | 3.7 | 3.3 | good | 2.9 |
| Compar. ex. 1 | — | 11.0 | bad | — | — | — | — |
| Compar. ex. 2 | — | 6.0 | bad | — | — | — | — |
| Compar. ex. 3 | — | 6.0 | bad | — | — | — | — |
| Example 3 | 10.5 | 5.5 | good | 4.1 | 3.0 | good | 3.1 |
| Example 4 | 10.5 | 5.5 | good | 3.8 | 3.3 | good | 3.5 |
| Example 5 | 60 | 13.5 | good | 4.6 | 11.5 | good | 4.3 |
| Example 6 | 60 | 7.5 | good | 4.6 | 11.5 | good | 4.3 |
| Example 7 | 60 | 3.5 | good | 4.6 | 11.5 | good | 4.6 |
| Compar. ex. 4 | — | 23.5 | bad | — | — | — | — |
| Compar. ex. 5 | 60 | 19 | good | 4.3 | 12.3 | bad | 3.9 |
| Compar. ex. 6 | — | 19 | bad | — | — | — | — |

*[1]PP = polypropylene (numerals indicate melt flow rate values according to JIS K6758)
PE = polyethylene (numerals indicate melt index values according to JIS K6760)

What we claim:

1. Polyolefin foamed fibers consisting of composite fibers having a single fiber fineness of 0.5 to 30 deniers and a fiber strength of 1.5 to 5.0 g/d, characterized in a structure wherein only a composite component dominantly forming the fiber surface of composite fibers along the direction of the fiber axis thereof is substantially foamed and a part of the resulting foamed cells are burst open on the fiber surface.

2. Polyolefin foamed fibers according to claim 1, which are used as short fibers of dry non-woven fabrics, having a crimp number of 5 to 15 crimps/inch and a fiber length of 30 to 180 mm.

3. Polyolefin foamed fibers according to claim 1 which are used as chopped strands for paper-making which are substantially non-crimped and have a fiber length of 1 to 20 mm.

4. Polyolefin foamed fibers according to claim 1 which are of crimped multifilaments.

5. Polyolefin foamed fibers according to claim 1 which are of non-crimped multifilaments.

6. In the process for producing composite fibers having a single fiber fineness of 0.5 to 30 deniers by stretching unstretched fibers having a single fiber fineness of 1.5 to 130 deniers to 2 to 8 times the original length thereof, a process for producing polyolefin foamed fibers which comprises adding a foaming agent substantially only to a composite component dominantly foaming the fiber surface of composite fibers along the fiber axis thereof (which component will hereinafter be abbreviated to B component), without adding any foaming agent to another composite component (which will hereinafter be abbreviated to A component), combining the composite components so that the composite proportion thereof, i.e. (A component)/(B component), is 30/70 or higher, and the theoretical average thickness of the B component in the cross-section of the unstretched fibers is in the range of 2 to 15 microns.

* * * * *